US005784756A

United States Patent [19]

Slocum et al.

[11] Patent Number: 5,784,756

[45] Date of Patent: Jul. 28, 1998

[54] DEBRIS CLEANER WITH COMPOUND AUGER AND VACUUM PICKUP

[75] Inventors: Alexander H. Slocum, Bow, N.H.; Martin L. Culpepper, Winthrop, Mass.

[73] Assignee: Massachusetts Institute of Technology, Cambridge, Mass.

[21] Appl. No.: 638,166

[22] Filed: Apr. 26, 1996

[51] Int. Cl.[6] ..... E01H 1/04

[52] U.S. Cl. ..... 15/348; 15/82; 15/182; 15/383; 15/DIG. 5; 37/257

[58] Field of Search ..... 15/82, 83, 179, 15/182, 366, 383, 348, DIG. 5, DIG. 6; 37/249, 257

[56] References Cited

U.S. PATENT DOCUMENTS

| | | | |
|---|---|---|---|
| 1,208,722 | 12/1916 | Kirby | 15/182 X |
| 1,957,506 | 5/1934 | Smellie | 15/366 |
| 2,134,396 | 10/1938 | Campbell | 15/348 X |
| 2,397,305 | 3/1946 | Wheat . | |
| 2,459,007 | 1/1949 | Taylor | 15/366 X |
| 2,809,389 | 10/1957 | Collins et al. . | |
| 2,941,223 | 6/1960 | Klauer | 15/82 X |
| 3,673,715 | 7/1972 | Lines . | |
| 3,695,716 | 10/1972 | Meyer . | |
| 3,766,586 | 10/1973 | Krickovich | 15/83 |
| 3,813,720 | 6/1974 | Sylvie . | |
| 3,999,316 | 12/1976 | Palmer . | |
| 4,203,237 | 5/1980 | Enters et al. . | |
| 4,221,018 | 9/1980 | Hajdu | 15/83 X |
| 4,322,896 | 4/1982 | Miyazawa et al. . | |
| 4,393,537 | 7/1983 | Reprogle et al. . | |
| 4,447,989 | 5/1984 | Vachon . | |
| 4,615,070 | 10/1986 | Frederick et al. . | |
| 5,427,573 | 6/1995 | Rutt et al. . | |

FOREIGN PATENT DOCUMENTS

| | | | |
|---|---|---|---|
| 6-30864 | 2/1994 | Japan | 15/383 |
| 2240354 | 7/1991 | United Kingdom | 15/83 |

OTHER PUBLICATIONS

The Toro Company, Rake–O–Vac Specifications brochure, pp. 49–51.

The Toro Company, Rake–O–Vac brochure, 1995.

Ingersoll, Garden Tractor Attachments brochure.

Gravely, ProVac, Pro Chip Series brochure.

*Primary Examiner*—Chris K. Moore
*Attorney, Agent, or Firm*—Testa, Hurwitz & Thibeault, LLP

[57] ABSTRACT

A debris cleaning device is equipped with a compound auger which has a rigid inner auger portion with auger fighting and a plurality of compliant combing attachments connected to the edge of the fighting. Instead of the compound auger, a helical rotary brush with a dense inner region of shorter stiffer bristles and a less populous outer region of longer bristles may be used. The cleaning device also has a suction mechanism with a nozzle located about at the midway point of the length of the auger (or rotary brush). The auger (or rotary brush) is positioned horizontally with its rotational axis co-linear with, or parallel to, an axle of supporting wheels so that the auger (or rotary brush) follows the contour of the surface being cleaned as do the wheels, thereby preventing the auger (or rotary brush) from digging into uneven terrain. The auger (or rotary brush) is positioned at a height above the surface which allows the outer edges of the compliant combing attachments (or longer bristles) to contact the surface. As the attachments (or longer bristles) engage the surface, they dislodge material and help convey it along the axis of the auger (or rotary brush) to a central collection area in front of the auger (or rotary brush) where the nozzle is located. The material is then drawn in through the nozzle by the suction mechanism. The pneumatically conveyed material is then shredded by a fan and exhausted to a collection hopper.

17 Claims, 9 Drawing Sheets

DEBRIS CLEANER WITH COMPOUND AUGER AND VACUUM PICKUP

STATEMENT REGARDING FEDERALLY SPONSORED RESEARCH

This invention was made with government support under Contract No. N00014-95-1G039 awarded by the Department of the Navy. The government may have certain rights in the invention.

TECHNICAL FIELD

This invention relates to debris cleaners for cleaning material such as leaves and paper from small or large properties such as lawns, golf course greens, parking lots, and airfields.

BACKGROUND INFORMATION

Some known lawn vacuums, such as the Gravely Pro Vic 1050, have a vacuum nozzle which extends across the width of the machine, and thus a high flow rate is needed to maintain a sufficient capture velocity at the nozzle entrance. To reduce the required flow rate, the area of the nozzle entrance can be reduced. Known lawn vacuums with reduced-area nozzles have a high width to depth ratio and thus have high loss from entrance effects and increased perimetral area. The reduced-area nozzles of these lawn vacuums extend across the width of the machines. These known lawn vacuums use large amounts of power. In addition, they generally are not able to dislodge embedded or wet debris from a surface such as a formal lawn. They also have long runs of ductwork which can become clogged with debris, and this causes down time as the machine must be shut off to clear the blockage.

Debris cleaners having brush pick up devices, known as sweepers, use one or more rotary brushes rotating at high speed to dislodge debris from the ground and propel it into a collection device. Sweepers are manufactured by, for example, the Toro Company. The Toro Company has the following models of sweepers: 44020, 44040, 44045, 44050, 44055, 44081, 44083, 44085, and 44089. Unlike the vacuum devices mentioned in the preceding paragraph, sweepers do not pass debris through a fan where its volume is reduced by shredding, and this increases the down time of sweepers as the debris-collecting hoppers on the sweepers must be emptied often. Also, the brushes must be rotated quickly to impart sufficient momentum to propel dislodged debris from the ground some distance into the hopper, and the fast moving brushes often damage delicate surfaces, such as formal lawns or golf course greens.

Some known machines combine aspects of sweepers and lawn vacuums. For example, a cleaner described in U.S. Pat. No. 2,809,389 has an axial fan, a system of ductwork, and a rotary sweeper brush. Problems with this cleaner include the fact that: the operating speed of the axial fan is limited to a range in which it will not stall; the axial fan must rotate at dangerously high speeds to achieve the static pressure needed for debris cleaning; and large amounts of power are required because the nozzle extends across the width of the cleaner as it does with known lawn vacuums. The Toro Rake-O-Vic combines brush and vacuum features, and it has power problems because the nozzle extends across the width of the machine. The device described in U.S. Pat. No. 4,615,070 has the same power problems experienced by known lawn vacuums because the brush has no centralizing feature and the nozzle extends across the width of the device. Also, the device has a brush sweeper with dense-packed bristles (for fine dirt collection) which would severely damage lawn surfaces and quickly become clogged with leaves.

Some known machines combine rotary brush and auger features. For example, the debris cleaners described in U.S. Pat. No. 4,393,537 and U.S. Pat. No. 3,695,716 use a rotary brush and a separate auger. The brush propels debris to the auger which then transports the debris to a desired location. These debris cleaners are not designed to remove debris from delicate surfaces, and they would cause damage to such surfaces. In addition, cost and complexity are added to the design as these cleaners have two separate rotary elements, the brush and the auger.

Some known debris cleaners are designed to work in conjunction with mower decks. Examples are Trac-Vic deck attachments and Ingersoll's Hydra Vic. With these cleaners, a mower blade lifts and shreds the debris, and a fan then blows the shredded debris through a long flexible duct into a pull-behind hopper. As with lawn vacuums, down time occurs often because the long flexible duct is prone to clogging. In addition, such designs require the use of a companion mower deck, and this may not be practical in many situations such as when used with all terrain vehicles which must use a rear mower deck.

Some known cleaning devices, such as upright vacuum cleaners and the apparatus disclosed in U.S. Pat. No. 5,427,573 and U.S. Pat. No. 3,813,720, use a type of auger brush for cleaning. These designs generally do not perform well on delicate surfaces such as a formal lawn because the bristles are either too stiff and thus damage the surface or too soft to convey the material.

Augers with components attached to their fighting or housings are known. For example, in U.S. Pat. No. 4,322,896, a strip of anti-friction material is attached to the edges of a snow blower auger which is in direct contact with the ground. The auger spins between 1300 and 1500 revolutions per minute. Residual friction between the attached strips and ground provides the force to propel the machine. This modification makes the machine self-propelled. Such designs generally are not be able to comb and lift embedded debris from delicate surfaces such as formal lawns, and the fast moving attachments will damage such surfaces. Another auger design is described in U.S. Pat. No. 2,397,305 as having a strip of wiping material attached to the edge of the auger fighting. This design generally can not effectively remove embedded debris from delicate surfaces, and it will damage such surfaces. In U.S. Pat. No. 4,203,237, a snow blower uses elastomeric auger flights attached to a drum. This design is ineffective in removing embedded debris, and it also is hampered by the fact that, like an upright vacuum cleaner, the spiraling members are attached to the outer edge of a drum. Use of a drum takes up space within the area of influence of the auger, and thus it reduces the effectiveness with which the auger or auger brush can convey solids. Also, the flights are designed to be stiff enough to offer sufficient resistance to heavy snow, and the use of these stiff flights on a delicate surface such as a lawn will cause damage to the grass and underlying surface. As described in U.S. Pat. No. 4,477,989, it is known to attach scarify teeth to the edge of snow blower auger. The teeth cut into packed snow to make it easier to convey the snow. This design would not work on delicate surfaces such as a formal lawn because the teeth would cause damage to the surface and the grass. In U.S. Pat. No. 3,673,715, raking tines are attached to the shaft of a snow blower auger, and the tines dislodge debris which is then transported by the auger to the snow blower discharge.

Although the tines can remove embedded debris from a lawn, the stiff tines and rigid auger blade would dig into the ground on uneven terrain and, as such, the device is not suitable as a debris cleaner. It is known to add a rotary rake and a collection bag to a snow blower, as described in U.S. Pat. No. 3,999,316. The rake dislodges material from the grass, and the dislodged debris is then conveyed by the auger to a fan which vacuums up the debris and deposits it into a collection bag. With this design, two rotary elements are needed to clean debris, and a skid located under the auger to prevent the auger from contacting the ground is used and positioned such that it could run into high spots on rolling terrain.

In general, known cleaners do not perform up to expectations. They generally are cumbersome to operate and inefficient with respect to power consumption.

SUMMARY OF THE INVENTION

This invention relates to a device for cleaning material (e.g., leaves, paper, and other debris) from delicate surfaces such as lawns and golf course greens and also from harder surfaces such as paved parking lots and airfields. In accordance with the invention, the device consumes less power than known cleaners and is more effective in picking up material that has traditionally been difficult to separate from the surface being cleaned. As compared to known cleaners, the device of the invention minimizes the amount of down time due to ductwork clogging and to repeated emptying of a collection device.

The cleaning device of the invention is equipped with a compound auger which has a rigid inner auger portion and also compliant combing attachments connected to the edge of the auger fighting. The compound auger may be replaced by a helical rotary brush with a dense inner region of bristles and a less populous outer region of bristles. Material properties and dimensions of the compliant combing attachments (or bristles) are chosen so that the surface being cleaned is not damaged during cleaning. The auger is positioned horizontally with its axis of rotation colinear with (or at least parallel to) an axle of a set of wheels supporting the cleaning device. The arrangement allows the auger to follow the contours of the surface being cleaned just as the wheels follow the contours but without the auger digging into or otherwise damaging the surface. The auger is positioned at a height which allows the outer edges of the compliant combing attachments to contact the surface. As the attachments engage the surface, they dislodge material therein and thereon, and they help convey the material along the axis of the auger to an area in front of the auger and located in the middle of the auger. The material is then drawn into the device, by a vacuum, through a nozzle located above the middle collection area. The cleaning device requires less power to operate than known cleaners because the auger directs the material to the central collection area where a smaller nozzle can be and is used, and this smaller nozzle requires a lower flow rate to maintain sufficient capture velocities at the nozzle entrance. The material is pneumatically conveyed through the nozzle to a centrifugal fan where it is shredded upon impact with the blades of the fan. The shredded material is then exhausted to a hopper. The hopper can be made from, for example, folded pieces of sheet metal or blow molded fiberglass which when put together form a rigid structure without the use of a dedicated frame. The cleaning device may be used in conjunction with a mower deck or other lawn and garden implements. A flexible hose may be attached to the ductwork of the cleaning device, and the hose can be used to vacuum manually areas impossible or impractical to reach with the auger/vacuum arrangement of the cleaning device. A valve on the side of the ductwork can be used to cut off airflow through the nozzle and direct the suction to the hose. The power provided to the auger and the fan (and any additional implements) is such that the speed of each powered component can be varied independently of the others.

The cleaning device of the invention can dislodge and pickup wet or embedded material from a surface such as a lawn with heavy grass cover. The compliant combing attachments aid in dislodging the material. The attachments may include compliant rubber fingers, a compliant material impregnated with soft bristles or wires, compliant bristles or wires, any combination of such mechanisms, or any other mechanism(s) which cause the desired effect of dislodging material without damaging the surface being cleaned. The dimensions and material properties of the attachments are chosen such that they do not cause damage to the surface.

An advantage of positioning the auger with its rotational axis substantially co-linear with (or at least parallel to) the axis of the wheel-supporting axle, and thus perpendicular to the device's direction of movement over the surface being cleaned, is that the auger will follow the contour of the surface as do the wheels. This prevents the auger from digging into the ground if the device were to pitch severely about the axle. If positioned on any other axis, an additional mechanism would be needed to ensure the proper height of the auger axis during such a scenario, and such a mechanism would add costs and complexity to the design of the cleaning device.

The cleaning device uses a vacuum system to convey material through a minimum amount of ductwork so as to minimize power loss and clogging in the ductwork. A centrifugal fan shreds the material as it comes into contact with the blades of the fan. The fan then exhausts the shredded material directly into a collection hopper, thereby eliminating the need for extra ductwork between the fan and collection hopper.

The foregoing and other objects, aspects, features, and advantages of the invention will become more apparent from the following description and from the claims.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DESCRIPTION

Figure 1:
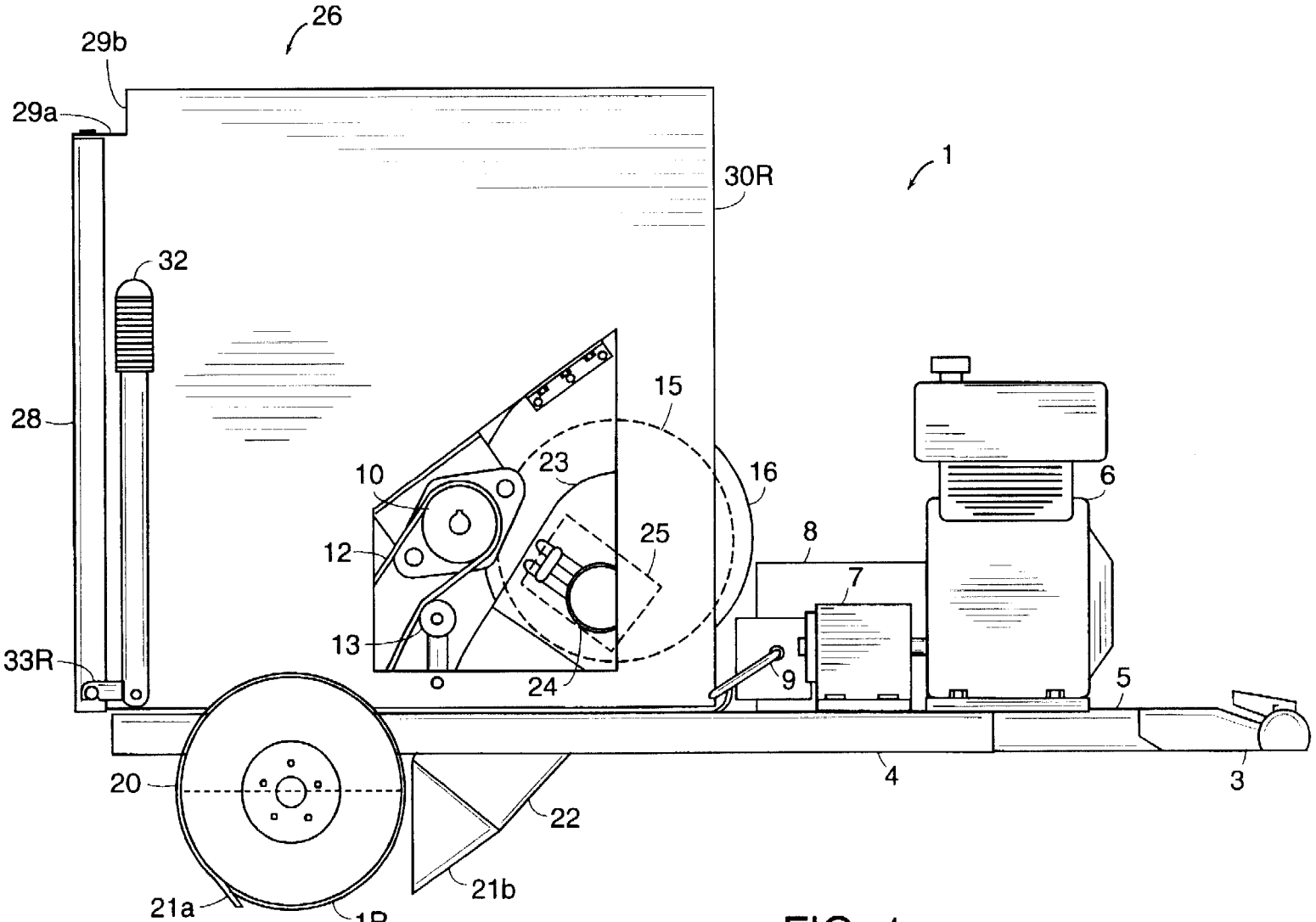
FIG. 1 is a side view of a debris cleaner according to the invention.
Figure 2:
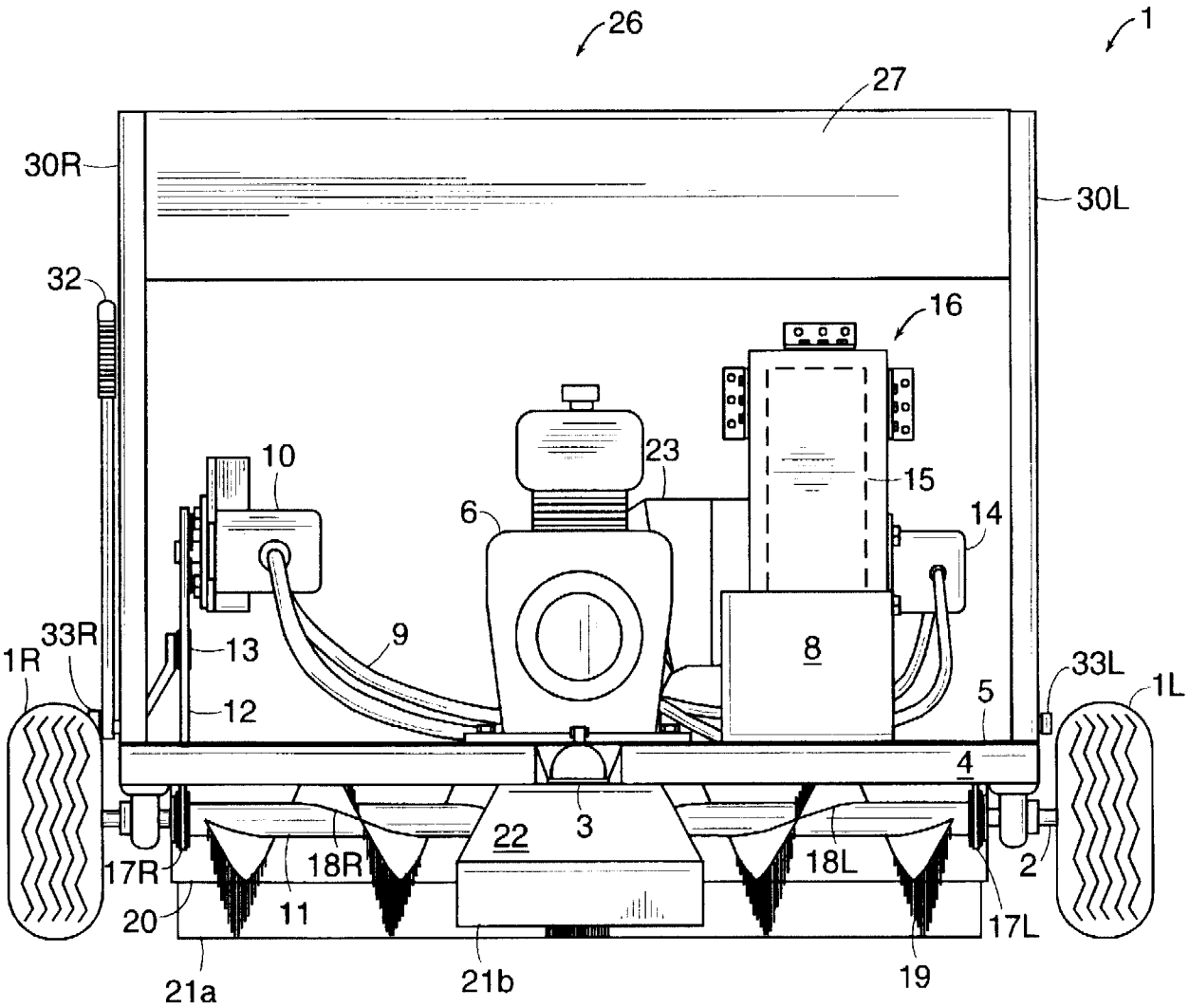
FIG. 2 is a front view of the debris cleaner of FIG. 1.
Figure 3:
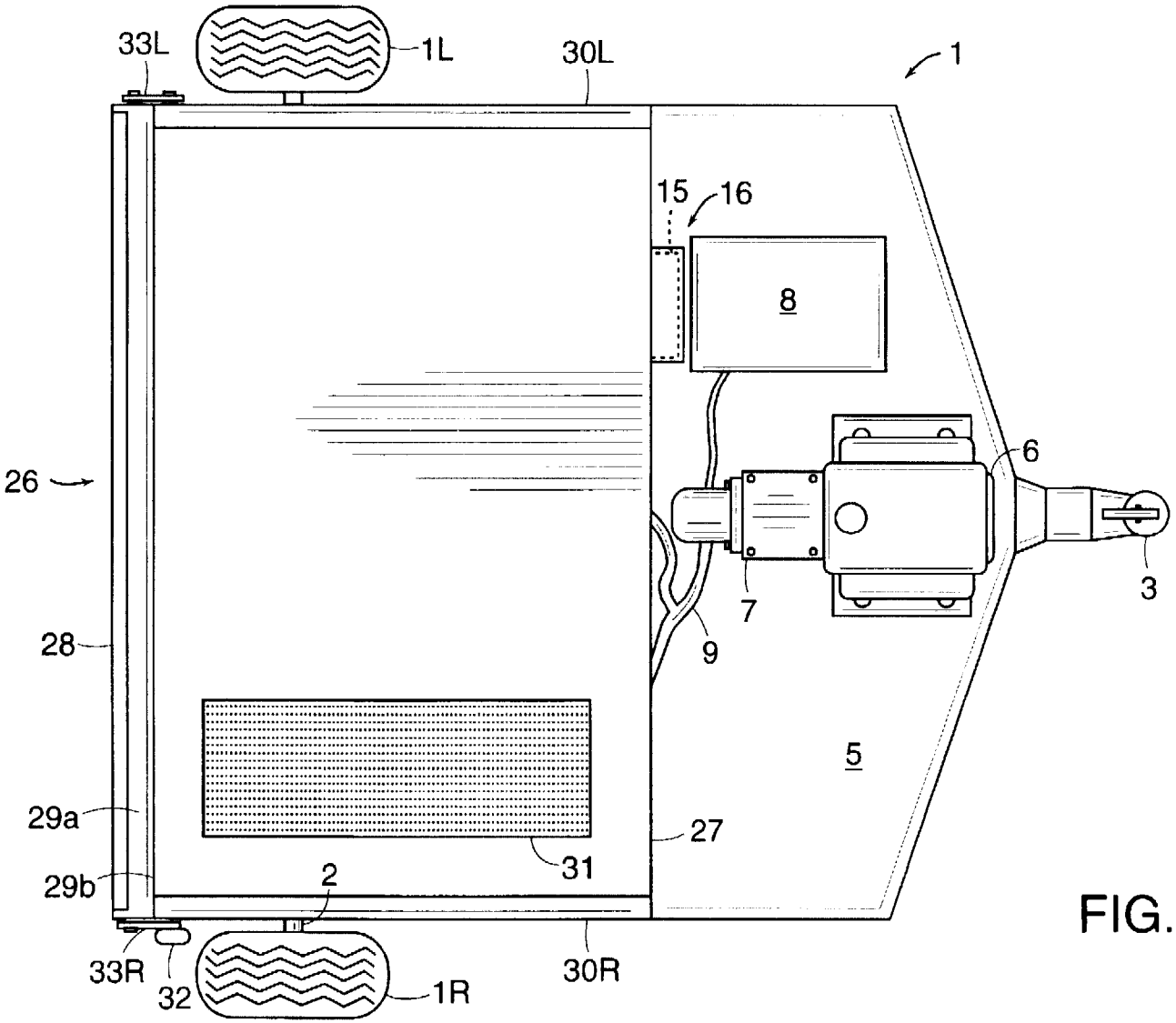
FIG. 3 is a top view of the debris cleaner of FIG. 1.
Figure 4:
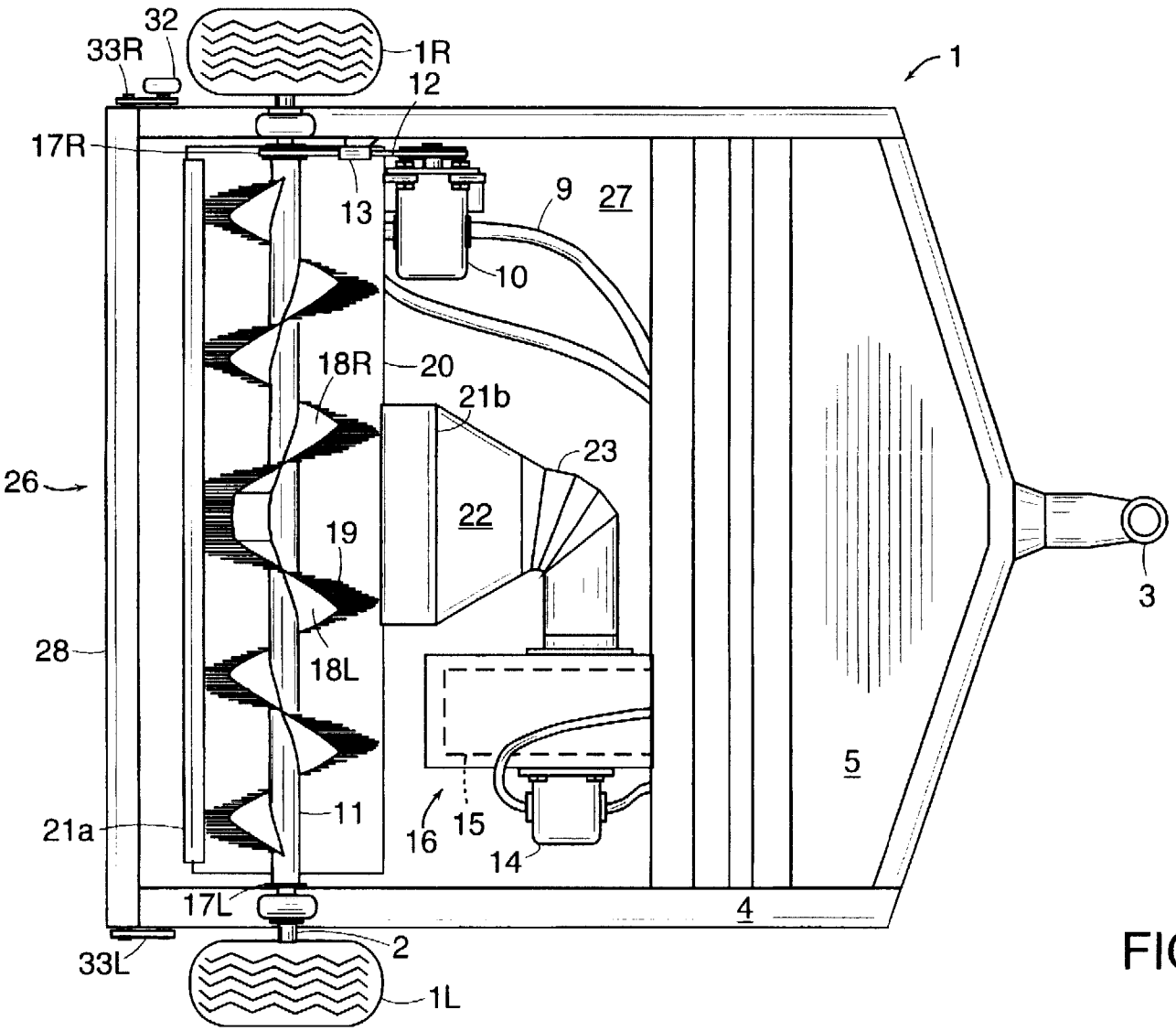
FIG. 4 is a bottom view of the debris cleaner of FIG. 1.

Referring to FIGS. 1, 2, 3, 4, and 6, a cleaning machine 1 according to the invention is supported by wheels IL, 1R on a horizontal axle 2. The axle 2 is disposed transverse to the direction of travel of the machine 1. A ball hitch 3 is used to attach the machine 1 to a pulling vehicle. Instead of the ball hitch 3, a similar attachment device can be used such as a pin hitch or a three point hitch. Alternatively, the machine 1 can be made self-propelled in which case it would not be necessary to use a pulling vehicle. Atop the front of the frame 4 is a platform 5 which provides a place to attach components of the drive train and other items.

In a preferred embodiment, either an internal combustion engine 6 or the power-take-off of a tractor can be used to power a pump assembly 7 which moves fluid from a reservoir 8 through hydraulic hoses 9 to a system of hydraulic motors in which the speed of any hydraulic motor can be adjusted separately from the others. One hydraulic motor 10 drives a compound auger 11 via a chain or belt 12. An adjustable idler sprocket or sheave 13 is provided to maintain tension in the chain or belt 12. Another hydraulic motor 14 drives the blades 15 of a centrifugal fan 16 directly or via a jack shaft. Other hydraulic motors may be added to drive auxiliary implements via chain or belt drives. In other embodiments, power could be provided to the fan 16 and the auger 11 using a system of clutches, belt drives, and gear boxes or clutches, chain drives, and gear boxes. In such embodiments, the drives would be configured to allow individual adjustment of the speeds of the driven components. All moving components presenting a safety hazard are either covered with safety shields or placed so as to prohibit entry into these areas or at least make entry difficult.

Either a solid, ribbon, or auger brush 11 rotates on bearings which are contained in the ends of the auger shaft or a suitable adapter 17L, 17R, attached to the ends. The horizontal, rotational axis of the auger 11 preferably is common with the axle 2 of the wheels such that the auger 11 follows the contour of the terrain. The axis of the auger 11 can be parallel and adjacent to the axle 2, instead of co-linear with it, and still follow the contour of the terrain being cleaned. Fighting 18L, 18R on either end of the auger 11 is of opposite pitch so as to transport debris to an area in front of the auger 11 and midway along its length. Rotation of the auger 11 may be either in the same or opposite direction of the wheels 1L, 1R, depending upon the surface being cleaned and the fighting 18L, 18R of the auger. The fighting is disposed around the core of the auger 11 in a generally helical or spiral fashion as shown. Both the fighting and the core of the auger 11 preferably are made of a rigid material or rigid composition of materials. Rigid metal or polymer can be used for the fighting and the core of the auger 11.

Figure 8:
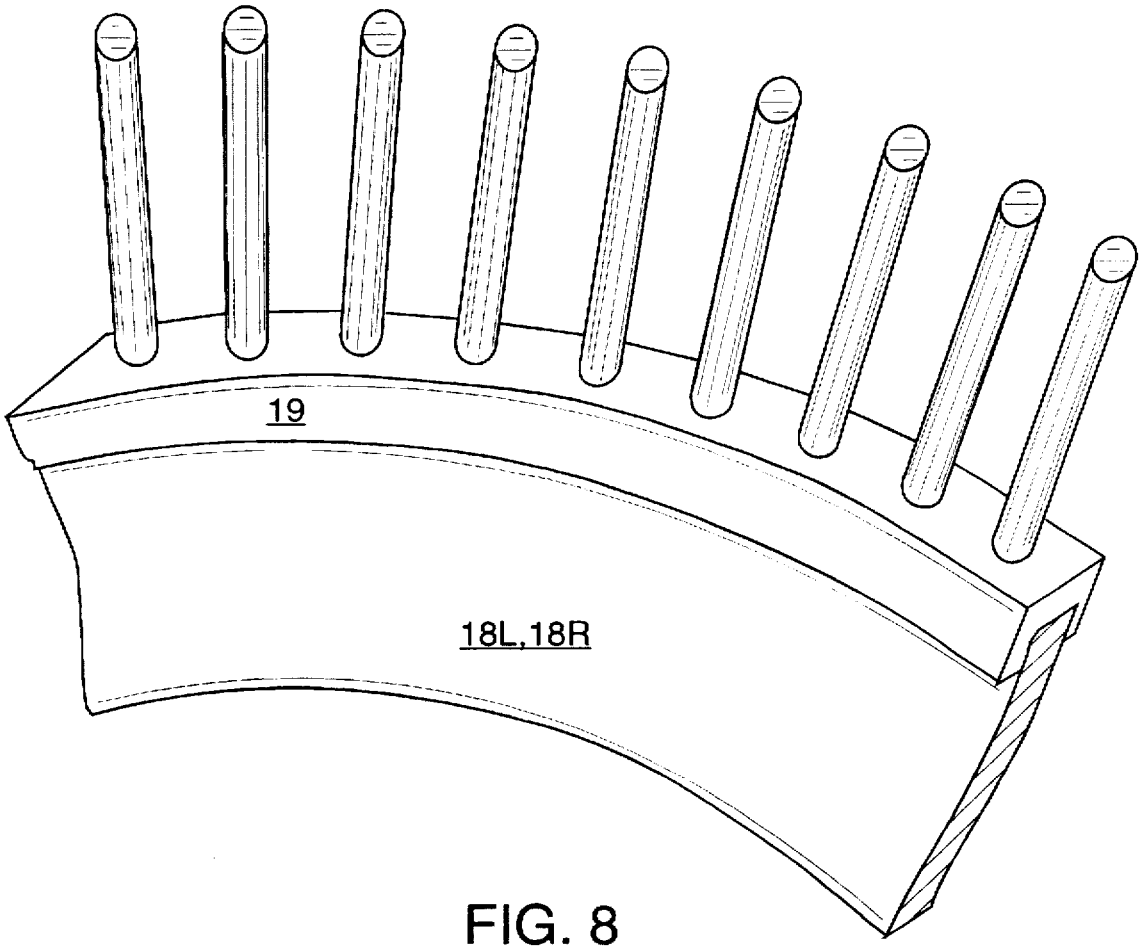
FIG. 8 is a diagram of one embodiment of compliant attachments on a rigid core of a compound auger of the cleaner.
Figure 9:
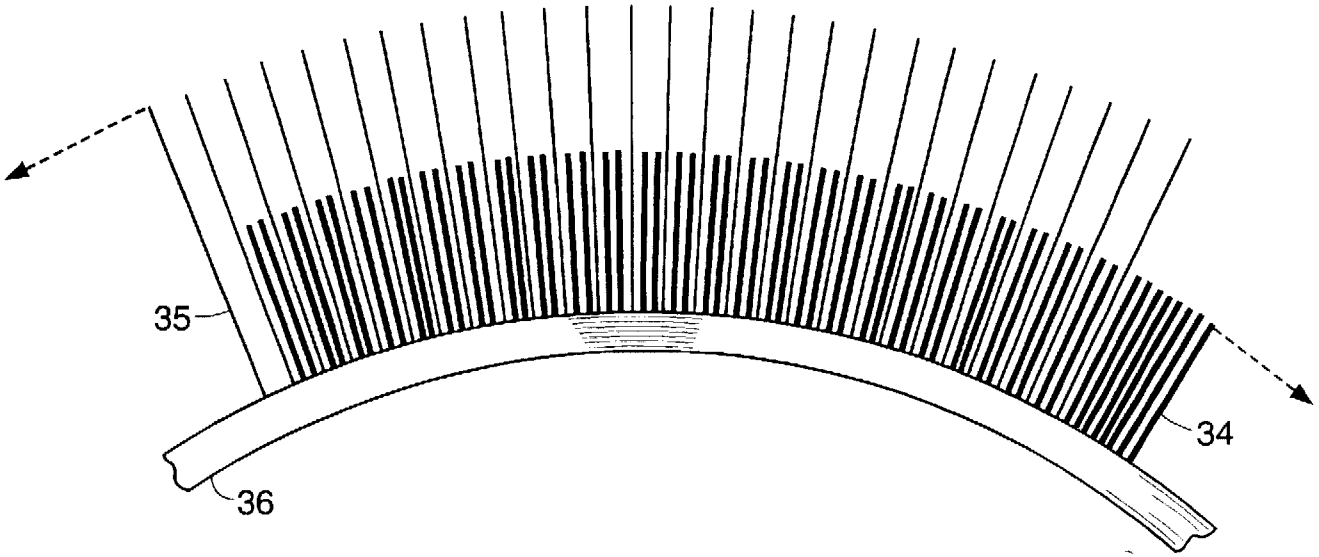
FIG. 9 is a diagram of one embodiment of a rotary brush for use in place of the compound auger of the cleaner.

The auger 11 is referred to as "compound" because fastened along the length of the edge of the rigid auger flights 18L, 18R are compliant combing attachments 19 capable of dislodging debris from a surface such as a lawn with heavy grass cover without damaging the surface. The attachments 19 also aid the rigid flights of the auger 11 in conveying the debris along the auger's axis of rotation to a midpoint where it can be vacuumed up by a suction device placed at that midpoint. An illustration of a possible way to connect the attachments is shown in FIG. 8 and FIG. 9. The attachments 19 can include, but are not limited to, compliant rubber fingers, a compliant material impregnated with soft bristles or wires, compliant bristles or wires, any combination of such mechanisms, or any other mechanism(s) which cause the desired effect of dislodging debris without damaging the surface being cleaned. The dimensions and material properties of the attachments 19 are chosen such that the attachments 19 offer sufficient resistance to the surface and debris so that effective cleaning results without damage to the surface. Materials which can be used for the attachments 19 include elastomers such as rubber. In general, any material that allows the attachments 19 to perform as described herein can be used.

The auger 11 is positioned substantially coaxially with the axle 2 of a supporting set of wheels so that clearance between the ground and the rigid portion of the auger 11 is kept fairly constant on flat or rolling terrain. This allows the compliant combing attachments 19 to be optimized for a minimum length at which sufficient resistance results to comb debris and aid the rigid portion of the auger 11 in large volume conveyance of material to the central collection area at the midpoint of the length of the auger 11 where a nozzle 22 is located.

A trough 20, attached to the frame 4 by its ends, partially encloses the auger 11. A portion of the trough 20 in front of, and along the length of, the auger 11 is left open to allow debris to contact the auger fighting 18L, 18R and the attachments 19. A compliant strip of material 21 a, such as an elastomer, attached along the rear edge of the trough 20 provides a moving seal which conforms to the terrain being cleaned and prevents debris from exiting the rear of the machine 1.

Figure 7B:
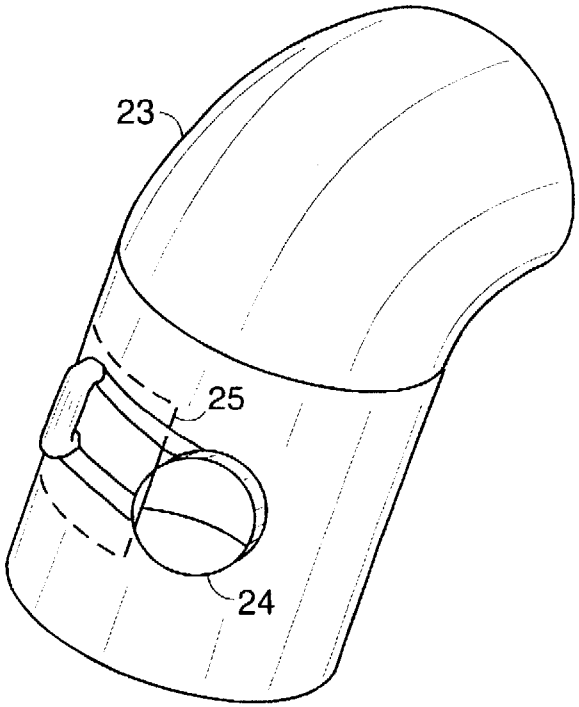
FIGS. 7A and 7B are diagrams of a manually-operable valve, in closed and opened positions, for an auxiliary vacuum hose of the cleaner.
Figure 7A:
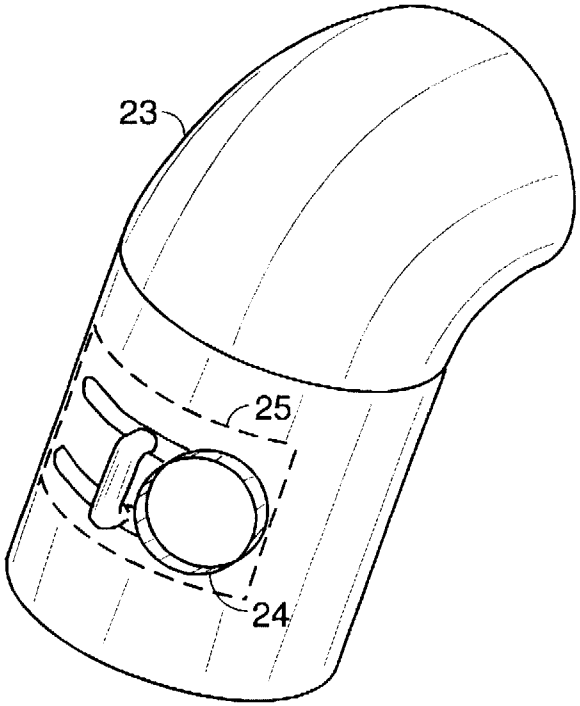

The debris is vacuumed into the nozzle 22 supported by the fan 16 inlet via a 90° elbow 23. The entrance to the nozzle 22 is placed slightly above and in front of the area in which the debris has been collected. As with the rear edge of the trough, a similar compliant strip of material 21*b* is attached to the perimeter of the nozzle 22 entrance so as to extend the influence of the nozzle 22 close to the ground without danger of the rigid nozzle 22 hitting high spots in the terrain. The nozzle is positioned such that sufficient velocities for capturing debris are maintained in front of the collection area. Referring to FIGS. 7A and 7B, a flexible hose can be attached to an adapter 24 on the side of the 90° elbow 23 where a door 25, when opened (FIG. 7B), will close off the air flow from the nozzle and draw debris through the flexible hose and into the elbow 23. This feature is provided for removal of debris in areas which are impossible or impractical for the machine 1 to clean.

The fan 16 is attached directly to the collection hopper 26. This allows the debris to dump directly from the outlet of the fan 16 into the collection hopper 26, thereby eliminating extra duct work in which power loss or clogging can occur. The fan 16 is powered via a jack shaft or hydraulic motor 14 as discussed previously. The blades 15 rotate at a speed sufficient to move the required air flow rate and shred debris upon contact with the blades 15. The shredding reduces the volume of the vacuumed debris before it is deposited into the collection hopper 26.

In one embodiment of the cleaning machine 1, the power consumption of the fan 16 is about 55% to 75% less than that of conventional debris cleaners, and the blades of the fan 16 rotate at a speed of about 1800 to 4000 rotations per minute.

The hopper 26 is attached to the rear of the frame 4 above the axle 2. The lower edge of the main body 27 is set at an angle which results in the hopper 20 being self-emptying upon opening of the door 28. Ridges 29*a*, 29*b* formed in the material of the upper rear portion of the main body 27 help make the hopper 26 rigid and furnish a place to hinge the door 28. Holes are cut in the side panels 30L, 30R to allow access to components of the machine 1 between the side panels 30L, 30R and below the lower edge of the main body 27. A vent 31 in the upper surface of the main body 27 filters debris particles out of the exhausted air.

Figure 5:
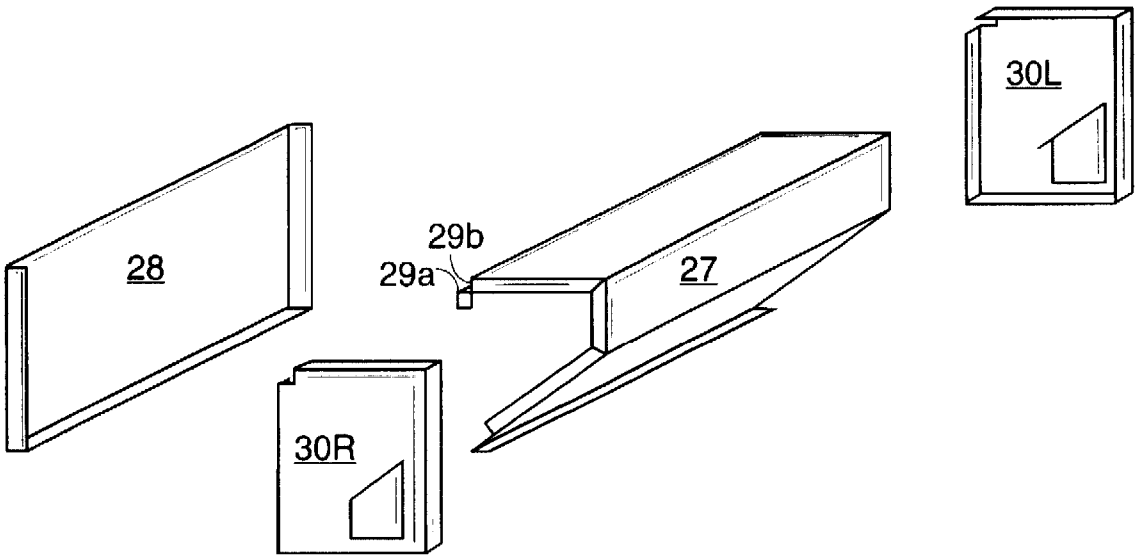
FIG. 5 is an exploded view of a collection hopper of the cleaner of FIG. 1.
Figure 6:
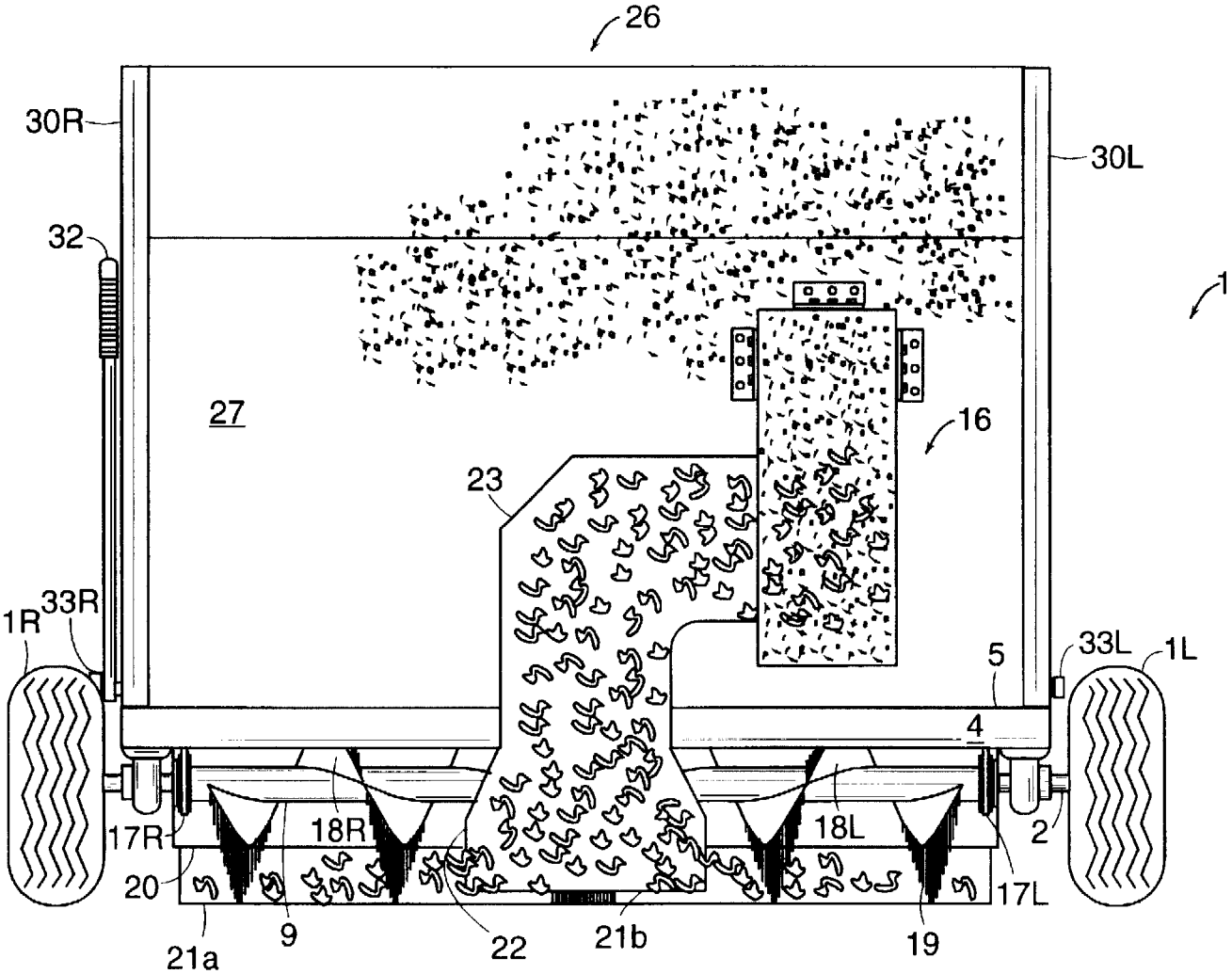
FIG. 6 is front view of the debris cleaner, partly in section, showing the path debris is conveyed.

The hopper 26 is made from pieces of folded sheet metal. It also is possible to mold the entire structure, or its components. Referring to FIG. 5, the bent edges of the side panels 30L, 30R are slid over the edges of the main body 27 until the bent edges of the main body 27 lie flush against the flats of the side panels 30L, 30R. When joined together, the folded edges of the main body 27 and side panels 30L, 30R essentially form an angle-iron frame where the bends of the side panels 30L, 30R and hopper main body 27 meet. This provides a strong, rigid structure without the use of a separate structural frame.

A door 28 is hinged to the horizontal ridge 29*a* on the upper rear of the main body 27. The bent edges on the door 28 overlap the rear of the side panels 30L, 30R and main body 27, thereby sealing off the enclosure. The door 28 is locked and unlocked by turning a handle 32 which operates two latches 33L, 33R at the lower rear of the hopper 26.

Additional description of the preferred auger design is provided below. A description of an auger brush which can be used in an alternative embodiment of the cleaning machine 1 according to the invention is also provided below.

In general, two limits control the design of the auger. On one extreme, a hard auger will gouge and damage the surface being cleaned. On the other extreme, bristles that are too soft will not collect and centralize the debris for the suction device. In addition, such soft bristles would have to be long in order to extend the radial influence of the bristles so that sufficient volumes of debris could be conveyed. The solution lies between these two extremes. In accordance with the invention, the combination of the rigid inner core part and flights of the auger 11 and the compliant combing outer attachments 19 serves: to dislodge debris from a surface without damaging the surface; to deliver a substantial portion of the dislodged debris to the inner flights of the auger 11 for material conveyance along the length of the auger 11; and to aid in that conveyance along the length of the auger 11. The auger 11 is positioned substantially coaxial with the axle 2 of the supporting wheels so that clearance between the ground and the rigid portion of the auger 11 is kept fairly constant on flat or rolling terrain. This allows the compliant combing attachments 19 to be optimized for a minimum length at which sufficient resistance results to comb debris and aid the rigid auger 11 in large volume conveyance of material to the central collection area located at the entrance to the nozzle 22.

In an alternative embodiment, the auger 11 and attachments 19 are replaced with a rotary brush made in the following manner. Referring to FIG. 9, two types of bristles or fingers 34, 35 could be arranged in a spiral fashion around the periphery of a shaft or drum 36. The shorter, stiffer bristles or fingers 34 form essentially an auger flight around the drum 36. The longer, more compliant brushes or fingers 35 function the same as the compliant attachments 19 which were added to the rigid flights of the compound auger 11.

Variations, modifications, and other implementations of what is described herein will occur to those of ordinary skill in the art without departing from the spirit and the scope of the invention as claimed. Accordingly, the invention is to be defined not by the preceding illustrative description but instead by the spirit and scope of the following claims.

What is claimed is:

1. A cleaning device comprising:

(A) an auger including a rotatable core with a first end and a second end, fighting around the core between the first and second ends, and compliant combing attachments along an edge of the fighting; and (B) a suction device with a nozzle at the midpoint of the length of the core;

whereby, when the core is rotated, the compliant combing attachments dislodge material from a surface with which they make contact without damaging the surface and the dislodged material is conveyed by the auger to the midpoint of the length of the core where it is vacuumed into the nozzle by the suction device.

2. The cleaning device of claim 1 wherein the axis of rotation of the auger is transverse to the direction of movement of the cleaning device over the surface.

3. The cleaning device of claim 2 further comprising wheels on which the cleaning device rolls as it moves over the surface.

4. The cleaning device of claim 1 wherein the compliant combing attachments comprise fingers.

5. The cleaning device of claim 1 further comprising a collection hopper located adjacent the suction device such that the suction device exhausts material directly into the collection hopper.

6. A cleaning device comprising:

(A) an auger including:

a rotatable core with a first end and a second end, a first flight around the core which extends from about the first end to about a midpoint of a length of the core, a second flight around the core which extends from about the second end to about the midpoint of the length of the core, the first and second flights having opposite pitch; and compliant combing attachments along respective edges of the first and second auger flights; and (B) a suction device with a nozzle at the midpoint of the length of the core;

whereby, when the core is rotated, the compliant combing attachments dislodge material from a surface with which they make contact without damaging the surface and the dislodged material is conveyed by the auger to the midpoint of the length of the core where it is vacuumed into the nozzle by the suction device.

7. The cleaning device of claim 6 wherein the axis of rotation of the auger is transverse to the direction of movement of the cleaning device over the surface.

8. The cleaning device of claim 7 further comprising wheels on which the cleaning device rolls as it moves over the surface.

9. The cleaning device of claim 6 wherein the compliant combing attachments comprise fingers.

10. The cleaning device of claim 6 further comprising a collection hopper located adjacent the suction device such that the suction device exhausts material directly into the collection hopper.

11. A cleaning device comprising:

(A) a brush device including:

a rotatable core with a first end and a second end, and a first set of bristles and a second set of bristles which are both disposed spirally around the core between the first and second ends, the first set of bristles being shorter, stiffer, and larger in number than the second set of bristles such that the first set of bristles form an auger flight around the core and the second set of bristles form compliant combing members extending out from the auger flight; and (B) a suction device with a nozzle at a midpoint of a length of the core;

whereby, when the core is rotated, the second set of bristles dislodge material from a surface with which they make contact without damaging the surface and the dislodged material is conveyed by the brush device to the midpoint of the length of the core where it is vacuumed into the nozzle by the suction device.

12. The cleaning device of claim 11 wherein the brush device comprises:

a first section in which the first and second set of bristles are both disposed spirally around the core and extend from about the first end of the core to about the midpoint of the length of the core; and a second section in which the first and second set of bristles are both disposed spirally around the core and extend from about the second end of the core to about the midpoint of the length of the core, the bristles in the first and second sections having opposite pitch.

13. The cleaning device of claim 11 wherein the axis of rotation of the brush device is transverse to the direction of movement of the cleaning device over the surface.

14. The cleaning device of claim 13 further comprising wheels on which the cleaning device rolls as it moves over the surface.

15. The cleaning device of claim 11 further comprising a collection hopper located adjacent the suction device such that the suction device exhausts material directly into the collection hopper.

16. A brush device comprising:

a rotatable core with a first end and a second end; and a first set of bristles and a second set of bristles which are both disposed spirally around the core between the first and second ends, the first set of bristles being shorter, stiffer, and larger in number than the second set of bristles such that the first set of bristles form an auger flight around the core and the second set of bristles form compliant combing members extending out from the auger flight.

17. The brush device of claim 16 further comprising:

a first section in which the first and second set of bristles are both disposed spirally around the core and extend from about the first end of the core to about the midpoint of the length of the core; and a second section in which the first and second set of bristles are both disposed spirally around the core and extend from about the second end of the core to about the midpoint of the length of the core, the bristles in the first and second sections having opposite pitch.

* * * * *